United States Patent [19]

Gray

[11] Patent Number: 4,821,538

[45] Date of Patent: Apr. 18, 1989

[54] SECURITY-PROVIDING CONTAINER DEVICE

[76] Inventor: Eric A. Gray, 1505 Richmond Dr., Zionsville, Ind. 46077

[21] Appl. No.: 93,788

[22] Filed: Sep. 4, 1987

[51] Int. Cl.[4] ..... E05B 73/00

[52] U.S. Cl. ..... 70/14; 70/58; 70/63; 70/160; 70/167; 109/5

[58] Field of Search ..... 70/14, 57, 58, 63, 158–161, 70/163, 164, 166–168; 109/50, 51, 52; 220/3.8, 210

[56] References Cited

U.S. PATENT DOCUMENTS

| | | | |
|---|---|---|---|
| 345,302 | 7/1886 | Hayes et al. | 109/51 X |
| 3,236,075 | 2/1966 | Williams | 70/63 |
| 3,370,446 | 2/1968 | Francis | 70/58 |
| 3,436,937 | 4/1969 | Barrett | 70/63 |
| 3,742,741 | 7/1973 | Cahan | 70/14 X |
| 3,757,549 | 9/1973 | Mullis, Jr. | 70/14 X |
| 3,931,723 | 1/1976 | Kurtz | 70/14 |
| 3,934,434 | 1/1976 | Law | 70/63 |
| 4,031,722 | 6/1977 | Michelman et al. | 70/63 |
| 4,051,790 | 10/1977 | Meditz et al. | 70/63 X |
| 4,066,307 | 1/1978 | Barding | 70/58 X |
| 4,099,593 | 7/1978 | Schultz | 70/160 X |
| 4,248,067 | 2/1981 | Sears | 70/63 X |
| 4,290,283 | 9/1981 | LaBrecque | 70/166 X |
| 4,448,049 | 5/1984 | Murray | 70/58 |
| 4,463,584 | 8/1984 | DeForrest | 70/63 |
| 4,493,268 | 1/1985 | Sidler | 70/63 X |
| 4,552,075 | 11/1985 | Glasson et al. | 109/52 |
| 4,577,563 | 3/1986 | Sidler | 109/52 |
| 4,694,668 | 9/1987 | Ciletti et al. | 70/63 |

*Primary Examiner*—Robert L. Wolfe
*Assistant Examiner*—Suzanne L. Dino
*Attorney, Agent, or Firm*—Robert A. Spray

[57] ABSTRACT

A container device by which a patron of a hotel or motel can leave articles such as shoes outwardly of the patron's room door for pick up and servicing by an attendant, but with the assuredness that the articles are locked for withdrawal only by an attendant who has lock-operation ability. No such ability is required of the patron, who achieves the locked condition of a container by the embrace of the patron's door by an abutment carried by a retainer connected to the container; and it is provided that the room door, in closed condition, itself is used both to block the container's access opening as well as to provide an abutment co-operating with the abutment to block movement of the device away from the door. The abutment is made movable, providing if desired another setting in which a full release of the container is achieved by pulling the abutment and its retainer outwardly of the door.

19 Claims, 1 Drawing Sheet

SECURITY-PROVIDING CONTAINER DEVICE

FIELD AND BACKGROUND OF THE INVENTION

This invention relates to a container device, and more particularly to a container device which provides security protection for its contents.

Even more particularly, the present invention relates to and achieves a container device especially useful for use by a patron of a hotel or motel, in placing an article outside the patron's door, for an intended servicing by an attendant, thus outside the patron's locked premises; yet, although outside the patron's locked premises, nevertheless the device handily provides sure protection for the article.

The service of shoes to be shined, with overnight pickup and delivery, represents a typical and perhaps a principle use of the invention; for the invention provides a handy and conveniently-usable depository, securely locked for the protection of the article.

THE PRIOR ART HAS NOT ACHIEVED THIS INVENTION

Prior art procedures for overnight shoe-shining or similar servicing have been merely for the patron to either leave the shoes outside the locked room door, thus subjecting them to being stolen, or else the patron would have to put up with the inconvenience of either taking the shoes to a central or attended service area, or be bothered by having to be present for an attendant to come to the room for both pickup and subsequent delivery of the shoes.

Such procedures have obvious disadvantages.

There are various types of locked containers for personal use of all types, from postal boxes to small safes, from soft drink machines to locked coat-check facilities, etc.; and all the components of the present invention are things of constructional and mechanical complexity, and indeed the present invention may appear simple when viewed from hindsight. Thus it is not only conceded but emphasized that the prior art could have achieved the present invention if the prior art had conceived of the concepts.

Further, room doors have been used for many years for temporary storage of articles such as hooks for clothing, and hangers for shoes and slippers, etc. Even hangers are known and used which utilize an edge of the door by a hook-member which spans the door, embracing the door on both sides thereof, somewhat similarly to the concepts of the present invention.

These and other factors of prior art knowledge and prior are devices are quite well known, to users, to hardware and container manufacturers, and to inventors the world over.

However, the existence of such articles and knowledge of the prior art is not only conceded, it is emphasized; for it is with similarities to long-known components and concepts that the present inventive concepts build, accomplishing a device of a construction and an operativity significantly different than just the components and operativities of all the articles of the prior art, and thus the inventive significance of the present concepts is emphasized, and the nature of the concepts and their results can perhaps be easier understood.

THE PRESENT INVENTION, SUMMARIZED

According to the present invention's concepts, a retainer member is provided to extend from a container, the retainer being small enough to pass past the gap between the base of the door and the floor; and the retainer carriers an abutment which is abuttingly engageable with the interior side or face of the door, holding the container in a securely-fixed position so closely adjacent the door that an access opening of the container is covered.

Two embodiments are here presented to illustrate the concepts. In one, the abutment is movable, by rotation of the retainer in response to a lock device, permitting the container to be pulled free of the door by an attendant. In another embodiment, the container has a locked access opening, for access to the shoes by an attendant without change of the abutment to release the container from adjacency to the door.

In both embodiments, plural-duty use is advantageously made of the already-present room door, and its already-present nature of being changed from open or closed condition, by the room patron; for the room door, in closed condition, is advantageously utilized as a fixed component providing the retaining and the opening-covering functions, without alteration and without hindering is conventional use.

THE INVENTION'S COMPONENTS AND CONCEPTS ARE SIMILAR TO THOSE AVAILABLE IN THE PRIOR ART, EXCEPT FOR THE PRESENT COMBINATION

In the hindsight consideration of the present invention to determine its inventive and novel nature, it is not only conceded but emphasized that the prior art had details usable in this invention, but only if the prior art had had the guidance of the present concepts.

That is, it is emphasized that the prior art has long had several particulars:

a. The prior art had containers, and retainers, and room doors which have both open and securely shut conditions, and even object-retainers which are attached to a door or which hang over a door;

b. The prior art has long known of the disadvantages of stolen articles, and of the tendency of non-locked articles to be stolen;

c. The prior art has long known of hotel or motel situations of a servicing of articles by overnight pickup and delivery;

d. The prior art has provided containers, including locked containers, for many types of article-depositing and removal.

e. Containers and retainers of the prior art have long been known to most all persons, and are not limited persons of high technology or inventive skill; and indeed it is with such conventional components and knowledge of the prior art that the concepts of this invention are advantageously provided;

f. Surely the fear of articles being stolen has limited the use of shoe-shine and other article-servicing business enterprises, as is surely known by the owners of such enterprises as being a cause of loss of income or of facility-appreciation;

g. All of these factors of prior art knowledge and components are well known and long known not only to surely all manufacturers of equipment as here involved but even to surely most all users of such equipment, and of hotels and motels, for which these concepts are advantageously to be used.

Accordingly, the various concepts and components and knowledge factors of the prior art are conceded and emphasized to have been widely known in the prior art; nevertheless, the prior art not having had such concepts, even only a fair amount of realistic humility, to avoid consideration of this invention improperly by hindsight, requires the concepts and achievement here to be realistically viewed as inventive in their nature.

BRIEF DESCRIPTION OF THE DRAWINGS

The above description of the novel and advantageous container device, which provides security against theft by a novel combination of features, is of somewhat introductory and generalized form. More particular details, concepts, and features are set forth in the following and more detailed description of illustrative embodiment, taken in conjunction with the accompanying drawings, which are of somewhat schematic and diagrammatic nature, for showing of the concepts and use of the present invention are illustrated in these embodiments.

In the drawings.

DETAILED DESCRIPTION OF EMBODIMENTS ILLUSTRATING THE INVENTION

Figure 1:
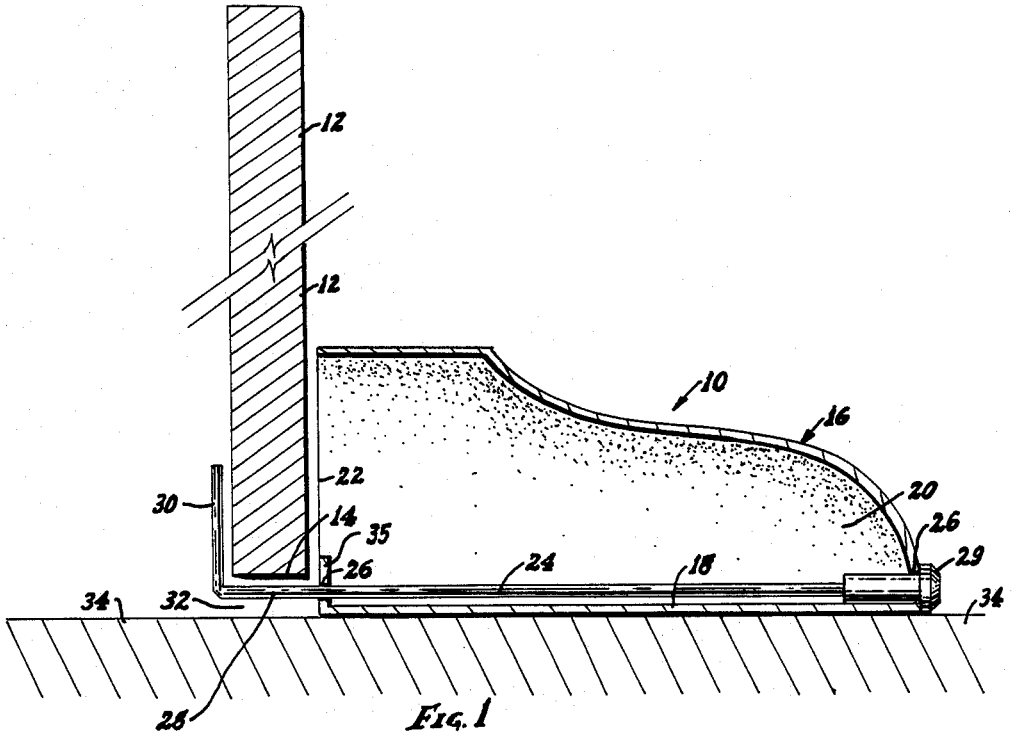
FIG. 1 is a vertical cross-sectional view through a device of a first embodiment, illustrating it removably attached to a typical room door.

As shown in the drawings, the present invention provides what may be referred to as a novel but nevertheless a security-providing container device 10; and per the concepts of the invention it is provided to have co-operation with a building door 12, for assuring against theft. The invention is particularly useful in the situation of a hotel or motel, for a safety-assured procedure of a patron leaving shoes outside the door 12, such as for overnight servicing.

A significant advantage is taken of the fact that a building door 12 has certain characteristics, and thus they need not be especially achieved for co-operation in the security achieved by the door. For example, a door 12 will have an open and a shut or closed condition, and in its closed condition provides a fixed and sturdy component. Also, there is a small gap between the floor and the base 14 of the door 12. Moreover, there is vacant space both inwardly and outwardly of a door 12; and there also is some vacant space along the free side edge of a door that is open. All such characteristics of a door 12 are advantageously here utilized, without need of any alteration. The invention's most conspicuous component is a container 16, here shown of a shape resembling a pair of shoes. The container 16 has a base 18, a hollow interior 20, and an access opening 22 which opens to the container's interior 20.

Also, there is shown a slender retainer means 24, and the container has support means 26 which support the retainer means 24 for rotation (27, FIG. 2) about its axis, and with a portion 28 of the retainer means extending from the container.

Lock means 29 are manually accessible from a portion of the container 16 removed from the portion of the container 16 from which extends the extending portion 28 of the retainer means 24; and the lock means 29 permit the retainer means 24 (including of course its extending portion 28) to be rotated (27) when manipulated.

Further as to the components of the embodiments as shown, the retainer means 24 is provided with an abutment 30 shown as an upturned integral extension of the extending portion 28. It is spaced from the axis of the retainer means 24/28, and is spaced from the portion of the container 16 containing its access opening 22 only an unsubstantial distance greater than the thickness of the base portion 14 of the door 12; and the container's support means 26 support the retainer means 24/28 at a low level, closely adjacent the container's base 18, such that the portion 28 of the retainer means 24 which extends from the container 16 (other than the abutment 30) can lie in the space or gap 32 between the base portion 14 of the door 12 and the floor 34. (Whether the abutment 30 can also lie or pass through the base space 32 depends on its setting, as detailed herein.)

The support 26 of the retainer means 24/28 is shown as in a flange 35, but it is sufficiently short in height so as to not block the access opening 22 in the condition (not shown) in which the device 10 is free and non-adjacent to the door 12.

With those basic components thus described, it will be seen that the arrangement provides for advantageous operativity; and that operativity is now described, first assuming that the door 12 is in open condition (not shown).

Suppose then that a patron desires to leave an article such as his shoes (not shown) outwardly of the door 12 such as for servicing and subsequent return by an attendant, but the patron fears theft. First, the patron deposits the article through the container's access opening 22 and into its interior 20; and then the patron places the container 16 containing his shoes onto the floor 34 outwardly of but adjacent the door 12 and adjacent the free side edge 36 of the door 12, with the base 18 of the container 16 lying on the floor. The door 12 is still assumed to be in open condition.

While the door 12 is still in open condition (not shown), the patron pushes the extending portion 28 of the retainer means 24 in the space 32 between the floor 34 and the base portion 14 of the door 12, toward a position 38 inwardly of the free side edge 36 of the door 12. Then, the patron closes the door 12; and this is the closed door condition shown in FIGS. 1 and 2.

Then, depending on the setting of the abutment 30, the patron may rotate (27) the extending portion 28 of the retainer means 24 so that, if it is not already above the base 14 of the door 12, the abutment 30 is rotated (27) to be above the base 14 of the door 12.

Thus, especially as seen in FIG. 1, this setting thus provides that the abutment 30 is engageable with the door 12 to block the retainer means 24/28 and container 16 from being pulled outwardly of the door 12, this being an abutting condition which exists unless and until the retainer means 24/28 is rotated (27) so as to bring the abutment 30 lower than the base 14 of the door 12, which thus frees or avoids any abutment or blocking of the abutment 30 with the door 12, that being a non-abutting condition.

Figure 2:
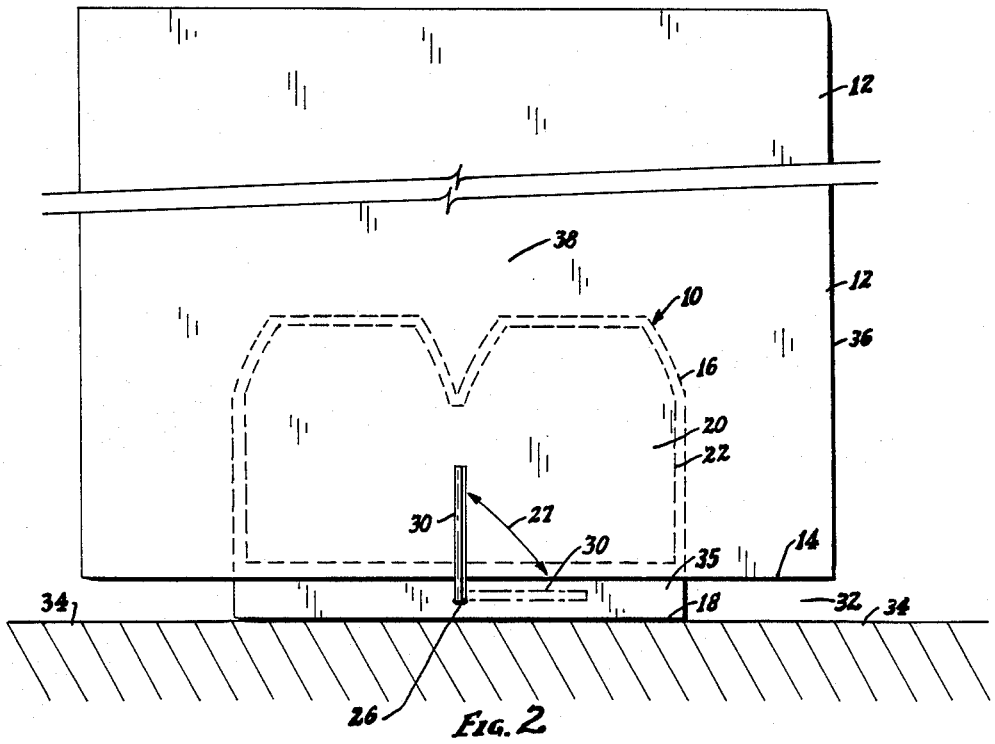
FIG. 2 is an elevation view of the assembly shown in FIG. 1.

As of then, the parts are in the "rest" condition of FIGS. 1 and 2, with the container 16 outside the door 12, the door 12 closed, and the shoes in the container 16. The container 16 is on the floor 34, and the access opening 22 is covered or effectively closed by the door 12; and the abutment 30 and the limited length of the extending port 28 prevent freeing of the container 16 from the door 12 even far enough to uncover the access opening 22.

Subsequently, an attendant, who has the means (key, combination, etc., depending on the lock 29) to unlock the lock means 29, can then unlock, the lock means 29 and achieve a rotation (27) of retainer means 24/28 to free its abutment 30 from abutting engagement with the door 12 by rotating (27) the abutment 30 from abutting condition to non-abutting condition (not shown, except by the chain-line showing of the abutment 30 in FIG. 2).

Now, since the abutment 30 is in its non-abutting (FIG. 2, chain lines) position, free of the door-base 14, the attendant can then pull the container 16 outwardly, fully free from adjacency to the door 12; and, during that movement, the extending portion 28 of the retainer means 24 including its abutment 30 all freely pass between the base 14 of the door 12 and the floor 34, becoming entirely free of the door 12.

The access opening 22 is then uncovered (from its earlier closure by the door 12); and the attendant can then remove the shoes from the container's interior 20; although, presumably the attendant would not want to leave the container 16 there in the hallway, so presumably he would take the container 16 to the sevice area, with shoes still inside the container 16. That would be a good way, assuming the container is tagged with the patron's room identification, for the attendant to remember which patron's room should receive back the shoes after servicing.

When the attendant has serviced the shoes and subsequently returns the shoes and container 16 to the patron's room, he places the container 16, with its base 18 lying on the floor 34, adjacent the closed door 12; and the attendant then rotates the retainer means 24/28 to its position in which the abutment 30 is not in abutting condition (chain lines in FIG. 2), unless of course the abutment 30 is is already in its non-abutting condition. In placing the container 16 adjacent the door 12, the attendant pushes the container 16 to a position close enough to the door 12 that the abutment 30 may be rotated again to its abutting condition inwardly of the plane of the door 12 as shown in, by pushing the abutment 30 and the extending portion 28 of the retainer means 24 of the retainer means 24 through the space 32 between the base 14 of the door 12 and the floor 32. He then rotates (27) the retainer means 24/28 to cause the abutment 30 to be moved in to its abutting condition as shown in FIGS. 1 and 2; and he locks the lock means 29 to block the retainer means 24/28 from being rotated (27) to change the abutment 30 from its abutting condition to a non-abutting condition.

As shown best in FIG. 1, the retainer means 24/28 is an L-shaped rod; and one leg of it provides the abutment 30 integrally from the extending portion 28. Also as best shown in FIG. 1, the container 16 is formed to resemble a pair of shoes, adding a novelty and a sort of self-advertising intrigue to the device 10.

It is to be noted that the device 10 is retained in its position of adjacency to the door 12 by the embrace or abutment of the interior side face of the door 12 by the abutment 30, and, when the lock means 29 is in a setting to block rotation (27) of the abutment 30 to non-abutting condition, the device 10 is removable from adjacency to the door 12 even while the abutment 30 is in abutting condition, by pushing the device 10 laterally toward and past the free side edge 36 of the door 12, during which travel of the retainer means 24/28 the extending portion 28 is in the space 32 between the floor 34 and the base portion 14 of the door 12; and thus, with the door 12 opened, the patron may get his serviced shoes from the container 16 even though the lock 29 is holding the abutment 30 in abutting condition, for once he frees the container 16 from the door 12 the access opening 22 is no longer covered by the door 12.

If desired, the blocking of the access opening can be by the floor 34 itself, if the access opening 22 is located on the container's base 18; and in that instance the door 12 is still used for its device-retaining co-operation with the abutment 30 as shown.

Any other fixed component of the building, in addition to the closed door 12 or the floor 34, such as a closely-adjacent side wall (not shown), may be used as the means for covering or blocking the access opening 22, depending upon in what portion of the container 16 the access opening 22 is located; but nevertheless the device 10 is held from removal away from the door 12, and in a position in which the access opening 22 is covered by the building's fixed component, by the abutment 30 abutting the interior side face of the door 12.

Regardless of which fixed component of the building is desired to be used to cover the container's access opening 22, it being appropriately located to achieve that effect, the lock means 29 associated with the retainer means 24/28 and the container 16 is such that, with the abutment means 30 in abutting condition as shown, while the door 12 is closed, only an attendant with lock-operation ability may move the retainer means 24/28 to change the abutment means 30 condition from one to the other of its abutting condition and non-abutting condition with respect to the interior face of the door 12; and thus the patron's shoes are safely kept against theft both before their pickup for servicing, and after they have been returned to the patron's room (outwardly of the door 12) after servicing.

CONCLUSION

It is thus seen that a security-providing container device, as constructed and used according to the inventive concepts herein set forth, provides novel concepts of a desirable and advantageous device, yielding the advantages of convenience for both the patron and the attendant, guarding against theft, and with handiness and operativity and use features almost as easy as merely putting the articles outwardly of a door in an unguarded condition, the device here achieving an anti-theft convenience to such an extent that the user is encouraged to use it upon any occasion of desired servicing by the servicing enterprise, and guarding against theft both before pickup and after delivery, especially desirable since the service would often be during the night and with the patron naturally wishing to be not bothered at either the pickup or delivery time. Assembly and dis-assembly from the associated door are both quite convenient, and no complex instructions are needed.

In summary as to the nature of these advantageous concepts, their inventiveness is shown by novel features of both concept and construction shown herein, and by the novel concepts hereof not only being different from all the prior art known, but because the achievement is not what is or has been suggested to those of ordinary skill in the art, especially realistically considering this as comprising what might be considered standard-type components which are surely well known to most manufacturers of this type equipment and including also surely most of the many thousands of patrons of hotels and motels the world around, many of whom have surely considered the hazards of leaving articles in an uprotected manner in a hallway and who personally know of inconvenience, loss of time and money, and other disadvantages of personal articles being stolen, especially since articles such as shoes are something as to which a patron of a hotel or motel would not likely have a duplicate set. All such knowledge of the need for something of the nature of this type equipment has been known for scores of years, the entire world over; and no high degree of technical or mechanical know-how would have been required, and the simplicity of the invention as per the illustrative embodiments is a factor showing its non-obviousness when realistically considered.

Yet, in spite of the prior art components including retainers used with a room door as a support, which hindsight might assert to have surely led to a suggestion of a convenient accommodation of some type of collection container co-operative with a room door to guard against theft, and in spite of what other hindsight might suggest, the realistic facts are that no prior art has suggested the modification of any prior art to achieve the particulars of the novel concepts here achieved, and even though various types of containers and lockable containers as a general concept have been known and used worldwide for many years as to many objects, and there are retainer hooks which achieve and provide support by spanning a door, and perhaps even apparatus such as exercise equipment may even have used the base of a closed door for a sturdy support purpose, quite certainly no particular combination of concepts achieving the present invention has been suggested by the prior art. Instead, this achievement has been a substantial departure from prior art, even though hotel and motel rooms, and article-servicing enterprises have needed an invention such as this for scores of years, and even though uses of components of the assembly in non-analogous fields and fields outside the field of endeavor of such interested persons and companies indicated above have not suggested the particulars of a device as herein set forth as to its embodiments.

And particularly is the overall difference from the prior art significant when the non-obviousness is viewed by a consideration of the subject matter as a whole, as incorporating the features both similar and different in comparison to the prior art, in contrast to merely those details of novelty themselves.

Accordingly, it will thus be seen for the foregoing description of the invention according to these illustrative embodiments, considered with the accompanying drawings, that the present invention provides new and useful concepts of a novel and advantageous security-providing container device, having and yielding desired advantages and characteristics in a construction and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

I claim:

1. A security-providing container device, for co-operation with a door having an open and a closed condition, the base portion of the door being slightly above the floor, the device comprising, in combination:

a container, the container having a base, a hollow interior, and an access opening which opens to the container's interior, a slender retainer means, the container having support means which support the retainer means for rotation about its axis, and with a portion of the retainer means extending from the container, lock means manually accessible from a portion of the container removed from the portion of the container from which the retainer means extends, the lock means permitting the retainer means to be rotated when manipulated, the retainer means provided with an abutment spaced from the axis of the retainer means, the abutment being carried by the said extending portion of the retainer means extending from the container, the support means supporting the retainer means closely adjacent the container's base, such that the portion of the retainer means which extends from the container can lie, and be moved past the plane of the door, between the base portion of the door and the floor, the arrangement providing for operativity as follows, assuming the door is then in open condition:

(a) when a patron desires to leave an article of the patron outwardly of the door, such as for servicing and subsequent return by an attendant, the patron deposits the article through the container's access opening and into its interior, and (b) the patron places the container onto the floor outwardly of but adjacent the door, and adjacent the free side edge of the door, with the base of the container lying on the floor, and (c) while the door is still in open condition, the patron pushes the extending portion of the retainer means in the space between the floor and the base portion of the door, to a position inwardly of the free side edge of the door, and (d) the patron closes the door, and (e) the patron may rotate the extending portion of the retainer means so that, if not already above, the abutment is rotated to be above the base of the door, thus providing an abutting condition of the abutment and door, with the abutment being engageable with the interior face of the door to block the container from being moved outwardly of the door, unless the retainer means is rotated to bring the abutment to a non-abutting condition in which the abutment is lower than the base of the door and thus free of abutment with the door, and (f) an attendant, who has the means to unlock the lock means, can then unlock the lock means and achieve a rotation of retainer means to free its abutment from abutting engagement with the door, by rotating it from abutting condition to non-abutting condition, and (g) the attendant can then pull the container outwardly, fully free from adjacency to the door, during which movement the extending portion of the retainer means, including its abutment, pass between the base of the door and the floor, and becomes entirely free of the door, and (h) when the attendant subsequently returns the patron's article and the container to adjacency to the closed door, the container base lying on the floor, the attendant rotates the retainer means to its position in which the abutment is not in abutting condition, unless it is already in non-abutting condition, and (i) the attendant pushes the container to a position closely adjacent the door such that the abutment may be rotated to abutting condition inwardly of the door when positioned inwardly of the door, and (j) an attendant then pushes the abutment and the extending portion of the retainer means through the space between the base of the door and the floor, and (k) the attendant then rotates retainer means to cause the abutment to be moved into abutting condition, and (l) the attendant locks the lock means to block the retainer means from being rotated to change the abutment from its abutting condition to a non-abutting condition.

2. The invention as set forth in claim 1, in a combination in which the abutment is spaced from the portion of the container which contains its said access opening only a small distance greater than the thickness of the base portion of the door, such distance being so small that when the container is positioned adjacent the door, with the extending portion of the retainer means disposed in the space between the base of the door and the floor, and with the abutment in abutting condition with a respect to the door, the said access opening is operatively closed by the door, preventing removal of an article which has been deposited in the container, even though the container and its said access opening are outwardly of the door, and even though the said access opening it not otherwise closed.

3. The invention as set forth in claim 1, in a combination in which the retainer means is an L-shaped, rod, one leg of which provides the abutment.

4. The invention as set forth in claim 1, in a combination in which the location of the said extending portion of the retainer means, with respect to the container, is such that even when the device is assembled to the door, with the extending portion of the retainer means disposed in the space between the base of the door and the floor, and even though the lock means is in a setting to block rotation of the abutment to non-abutting condition, the device is removable from the adjacency to the door, even while the abutment is in abutting condition, by pushing the device laterally toward and past the free side edge of the door, the travel of the retainer means during said pushing movement being in the space between the floor and the base portion of the door.

5. A security-providing container device, for cooperation with a building having a door having an open and a closed condition, and the building having its said door and adjacent flooring as fixed components, the device comprising:

a container having a hollow interior and an access opening providing access thereto, a retainer means having an abutment means, the retainer means being supported by the container such that the abutment means of the retainer means is movable between and into an abutting condition with respect to the interior face of the door and a non-abutting condition with respect thereto, the retainer means and its abutment means providing that when the abutment means is in its said abutting condition of abutting the interior face of the door, the container's access opening is adjacent one of the buildings'fixed components such that the access opening is operatively blocked by the fixed component, and lock means associated with the retainer means and the container such that, with the abutment means in abutting condition, an attendant with lock-operation ability may move the retainer means to change the abutment means condition from one to the other of its abutting condition and non-abutting condition with respect to the interior face of the door.

6. The invention as set forth in claim 5, in a combination in which the retainer means is an L-shaped rod, one leg of which provides the abutment means.

7. The invention as set forth in claim 5, in a combination in which the support of the retainer means by the container is such that its movement between abutting and non-abutting condition of the abutment means is rotational.

8. The invention as set forth in claim 5, in a combination in which the relationship of abutment means, retainer means, and container is such that the building's first component whose adjacency blocks the access opening is the building's door when in closed condition.

9. A security-providing container device, for cooperation with a building having a door having an open and a closed condition, and the building having its said door and adjacent flooring as fixed components, the device comprising:

a container having a hollow interior and an access opening providing access thereto, a retainer means having an abutment means, the retainer means having its abutment means engageable with the interior face of the door when the container is outwardly of the door and with the retainer means extending past the general plane of the door and interconnecting the container and the abutment means, the retainer means and its abutment means providing that when the abutment means is engageable with the interior face of the door, with the door being in closed condition and the container outwardly of the door, the container access opening is adjacent one of the building's fixed components such that the access opening is blocked by the fixed component, and the container having a lock means by which an attendant with lock-operation ability may have access to the container's interior, without moving the door from its closed condition, in a combination in which the said retainer means is supported by the container, and the said retainer means is movably supported by the container such that the abutment means may be moved between an abutting condition abutting the interior face of the door, and a non-abutting position in which the abutment means may pass under the door.

10. The invention as set forth in claim 9, in a combination in which the movability of the retainer means is rotational so as to rotate the abutment means into and between its said abutting and non-abutting conditions.

11. The invention as set forth in claim 9, in a combination in which the adjacency of the access opening to one of the building's fixed components is provided by the span of the retainer means between the abutment means and the container being only an insignificant amount greater than the thickness of the door.

12. The invention as set forth in claim 9, in a combination in which the retainer means and its support by the container are such that the container may be placed outside the door, the door then being in open condition, just outwardly of the free side edge of the door, and with the container adjacent the door such that the abutment means is inside of the plane of the door, then in such condition the device as a whole may be pushed inwardly of the door's free edge whether or not the abutment means is then in abutting or non-abutting condition.

13. The invention as set forth in claim 9, in a combination in which the lock means is operative to move the retainer means to move the abutment means from abutting to non-abutting condition with respect to the door, thereby freeing the device so that it may be moved outwardly free of the door.

14. The invention as set forth in claim 9, in a combination in which the retainer means is operatively connected to the container, and the retainer means and its connection to the container are such that the container may be placed outside the door, the door then being in open condition, just outwardly of the free side edge of the door, and with the container adjacent the door such that the abutment means is inside of the plane of the door, then in such condition the device as a whole may be pushed inwardly of the door's free edge, to a position in which the abutment means is engageable with the interior face of the door when the container is on the floor.

15. The invention as set forth in claim 9, in a combination in which the container is provided with two access openings, a first one being the access opening blockingly adjacent one of the building's fixed components, and the second being an opening which is not blocked by one of the building's fixed components but is covered by a closure cover whose closure is regulated by the lock means, the lock means permitting access to the container interior by an attendant with lock-operation ability even while the device is positioned adjacent the building's fixed component such that said first access opening is blocked thereby.

16. The invention as set forth in claim 9, in a combination in which the relationship of abutment means, retainer means, and container is such that the building's first component whose adjacency blocks the access opening is the building's door when in closed condition.

17. The invention as set forth in claim 9, in a combination in which the relationship of abutment means, retainer means, and container is such that the building's first component whose adjacency blocks the access opening is the building's door when in closed condition.

18. The invention as set forth in claim 14, in a combination in which the relationship of abutment means, retainer means, and container is such that the building's first component whose adjacency blocks the access opening is the building's door when in closed condition.

19. The invention as set forth in claim 14, in a combination in which the container is formed to resemble a pair of shoes.

* * * * *